US009246257B2

(12) United States Patent
Shimoyasu et al.

(10) Patent No.: US 9,246,257 B2
(45) Date of Patent: Jan. 26, 2016

(54) CONNECTOR

(71) Applicant: Tyco Electronics Japan G.K., Kanagawa-ken (JP)

(72) Inventors: Takashi Shimoyasu, Kanagawa-ken (JP); Shinji Yamada, Kanagawa-ken (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 14/511,567

(22) Filed: Oct. 10, 2014

(65) Prior Publication Data

US 2015/0104972 A1 Apr. 16, 2015

(30) Foreign Application Priority Data

Oct. 10, 2013 (JP) ..... 2013-212811

(51) Int. Cl.

| | |
|---|---|
| ***H01R 13/73*** | (2006.01) |
| ***H01R 13/502*** | (2006.01) |
| ***H01R 13/516*** | (2006.01) |
| ***H01R 13/506*** | (2006.01) |
| ***H01R 13/74*** | (2006.01) |

(52) U.S. Cl.

CPC ..... *H01R 13/502* (2013.01); *H01R 13/506* (2013.01); *H01R 13/516* (2013.01); *H01R 13/743* (2013.01)

(58) Field of Classification Search

CPC .. H01R 13/502; H01R 13/516; H01R 13/506; H01R 13/743; H01R 13/745; H01R 13/6273

USPC ..... 439/575

See application file for complete search history.

(56) References Cited

U.S. PATENT DOCUMENTS

| | | | | |
|---|---|---|---|---|
| 4,711,507 | A * | 12/1987 | Noorily | H01R 13/6273 29/869 |
| 5,279,507 | A * | 1/1994 | Kameyama | B60R 16/0222 439/270 |
| 5,613,876 | A * | 3/1997 | Sakatani et al. | B60R 16/02 296/146.5 |
| 7,575,473 | B2 | 8/2009 | Kodama et al. | |
| 7,708,589 | B2 * | 5/2010 | Shuey | H01R 13/745 439/552 |

FOREIGN PATENT DOCUMENTS

| | | |
|---|---|---|
| JP | 3-116677 U | 12/1991 |
| JP | 2005-302582 A | 10/2005 |
| JP | 2009-146862 A | 7/2009 |

* cited by examiner

*Primary Examiner* — Jean F Duverne
(74) *Attorney, Agent, or Firm* — Barley Snyder

(57) ABSTRACT

An electrical connector housing is disclosed having a first housing member, and a second housing member mated with the first housing member. A front wall is disposed on an outer surface of at least one of the housing members and extends perpendicular to an insertion direction. A first sidewall is disposed on the outer surface of the first housing member and extends along the insertion direction, perpendicular to the front wall. A second sidewall is disposed on the outer surface of the second housing member and extends along the insertion direction, parallel with the first sidewall and perpendicular to the front wall. A cantilevered first lock arm extends along an insertion direction and is positioned between the first sidewall and second sidewall. The lock arm includes a fixed end, a free end, and a hook.

14 Claims, 4 Drawing Sheets

CONNECTOR

CROSS-REFERENCE TO RELATED APPLICATION

This Application claims priority under 35 U.S.C §119(a)-(d) to Japanese Patent Application No. 2013-212811, filed Oct. 10, 2013.

FIELD OF THE INVENTION

The present invention relates to a connector for attachment to a panel.

BACKGROUND

Connectors that attach to openings in a panel are commonly used in a variety of application. Conventionally, these connectors have a cantilevered lock arm for engaging with an edge of an attachment opening of the panel. The lock arm is typically positioned on a connector housing, and is produced through resin molding.

One common problem with the conventional design is that the lock arm is exposed, which easily allows a foreign object to intrude under the lock arm. When the connector is attached to the panel, the panel functions as a protecting member for the lock arm. However, the connector is not limited to use with the panel, but is also directly coupled with a mating connector, without the interposition of the panel. When the lock arm is not attached to the panel, a foreign object, such as a cable or debris, might intrude under the lock arm, lift up the lock arm, and damage the lock arm.

Japanese Patent Application No. 2005-302582A discloses a connector in which walls are formed on both sides of the lock arm, so that intrusion of a foreign object from the sides is prevented. However, since a mold structured so as to be drawn frontward from the lock arm is used for manufacturing the lock arm, the connector inevitably has a structure in which the front of the lock arm is opened. Therefore, this design is unable to prevent a foreign object from intruding from the front of the lock arm.

There is a need for a connector having a wall formed in front of the lock arm so that a foreign object is prevented from intruding from the front of the lock arm. Further, there is a need for this connector to use a mold structured so as to be drawn sideways, as well as having a structure in which at least one side of the lock arm is opened and intrusion of the foreign object from the side can be prevented.

SUMMARY

An electrical connector housing has a first housing member, and a second housing member mated with the first housing member. A front wall is disposed on an outer surface of at least one of the housing members and extends perpendicular to an insertion direction. A first sidewall is disposed on the outer surface of the first housing member and extends along the insertion direction, perpendicular to the front wall. A second sidewall is disposed on the outer surface of the second housing member and extends along the insertion direction, parallel with the first sidewall and perpendicular to the front wall. A cantilevered first lock arm extends along an insertion direction and is positioned between the first sidewall and second sidewall. The lock arm includes a fixed end, a free end, and a hook.

According to the connector of the present invention, since the front wall is formed in front of the lock arm, and the sidewalls are formed on both sides of the lock arm, intrusion of a foreign object from the front and the sides is prevented.

BRIEF DESCRIPTION OF THE DRAWINGS

The invention will now be described by way of example, with reference to the accompanying figures, of which.

DETAILED DESCRIPTION OF THE EMBODIMENT(S)

A connector 1 has a body 10 and a housing 20. The body 10 is made of metal and the housing 20 is made from resin.

The body 10 has a contact (not shown) connected to a core of a cable 2, and a housing (not shown) where the contact is positioned therein. The body 10 is electrically connected to a shield braid 2*a* (see FIG. 2) of the cable 2, and also makes electrical connection with a shield (not shown) of a mating connector (not shown).

Figure 1:
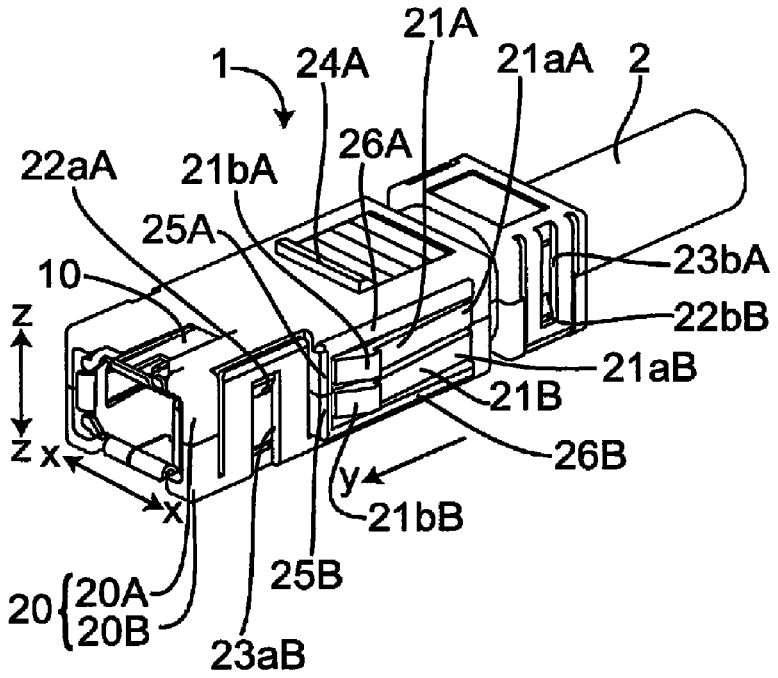
FIG. 1 is an external perspective view of a connector as an embodiment of the present invention.
Figure 2:
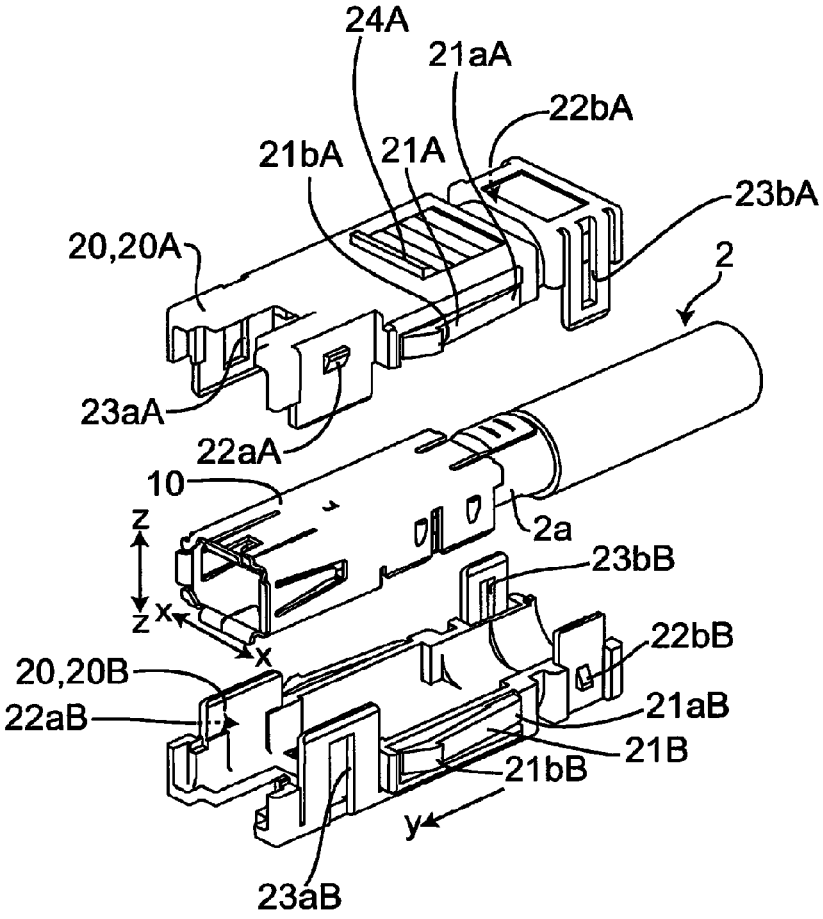
FIG. 2 is an exploded perspective view of the connector whose external view is shown in FIG. 1.

The housing 20 includes a pair of resin-molded housing members 20A, 20B. The pair of housing members 20A, 20B are fitted complementary to each other in a mating direction indicated by arrow z-z in FIG. 1 and FIG. 2, to cover the body 10 and form outer walls on the connector 1. In an embodiment, the pair of housing members 20A, 20B have identical shapes, and are complementarily structured so as to be mateable with each other when facing in the opposite directions, as shown in FIG. 2. The housing 20 covers the body 10 so that an accidental short circuit to the body 10 is avoided, and is also used to attach the connector 1 to the panel 3 shown in FIG. 3.

Figure 3:
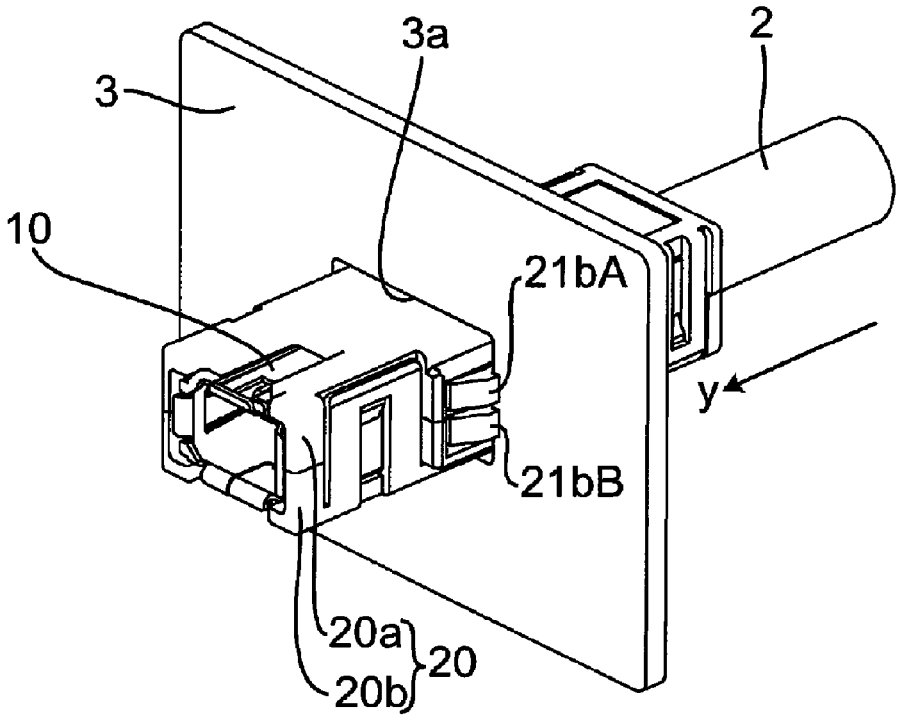
FIG. 3 is a perspective view showing the connector whose external view is shown in FIG. 1 in the state of being attached to a panel.

In an exemplary embodiment shown in FIG. 3, a connector receiving opening 3*a* is formed in a panel 3. The connector 1 is inserted into the connector receiving opening 3*a* in an insertion direction indicated by arrow y, and attached to the panel 3.

Two lock arms 21A, 21B are formed on each of the side faces of the connector 1 in a width direction (direction of arrow x-x) crossing both the insertion direction (direction of arrow y-y) and the mating direction (direction of arrow z-z) of the connector 1. FIGS. 1-3 show only one face of the side faces. The lock arms 21A, 21B are symmetrical on both the side faces in the width direction (direction of arrow x-x). Therefore only the structure of the one side face shown in FIG. 1 to FIG. 3 will be described below.

The two lock arms 21A, 21B are positioned parallel and adjacent to each other, and extend along the insertion direction (direction of arrow y) from fixed ends 21*a*A, 21*a*B in a cantilever fashion, and have hooks 21*b*A, 21*b*B projecting outward on free ends 21*c* thereof. In an embodiment shown in FIG. 2, one of the two lock arms 21A, 21B is formed on the housing member 20A, and the other is formed on the other housing member 20B. The lock arms 21A, 21B are positioned adjacent to each other in a side by side positioning when the two housing members 20A, 20B are mated together.

A mating projection 22*a*A, 22*a*B is formed on one side face of each of the two housing members 20A, 20B in the width direction (direction of arrow x-x) and on a forward side of the insertion direction (direction of arrow y). On the opposite side face of each housing member 20A,20B, a mating projection receiving groove 23*a*A, 23*a*B is formed. In the embodiment shown in FIG. 2, the mating projections 22*b*A, 22*b*B and mating projection receiving grooves 23*b*A, 23*b*B are formed on one side face and the other opposing side face, respectively, on each of the two housing members 20A, 20B.

While both the mating projections 22*a*B, 22*b*A are not directly shown in FIGS. 1-3, since the two housing members 20A, 20B are have identical shapes, the mating projections 22*a*B, 22*b*A which are not shown, correspond to the mating projections 22*a*A, 22*b*B.

In the embodiment shown in FIGS. 1 and 2, the two housing members 20A, 20B are mated together by aligning the mating projection 22*a*A with the corresponding mating projection receiving groove 23*a*B and the mating projection 22*a*B with corresponding mating projection receiving groove 23*a*A. The two housing members 20A,20B are brought together such that the mating projections 22*a*A,22*a*B are receiving in the mating projection receiving grooves 23*a*A, 23*a*B, thereby forming the housing 20.

When the two lock arms 21A, 21B are inserted into the connector receiving opening 3*a* of the panel 3 in the insertion direction (direction of arrow y), the hooks 21*b*A, 21*b*B are pressed and deflected inward by the edge of the attachment opening 3*a*. After the hooks 21*b*A, 21*b*B pass through the attachment opening 3*a*, the lock arms 21A, 21B return outward due to their own elasticity, as shown in the embodiment of FIG. 3. Locking projections 24A, 24B (the locking projection 24B is not shown) are positioned on the upper and lower faces of the housing 20. Once the connector 1 is inserted into a position in which the lock arms 21A, 21B are released from the deflection, the connector 1 is fixed to the panel 3 while holding the panel 3 with the locking projections 24A, 24B and the hooks 21*b*A, 21*b*B. To detach the connector 1 from the panel 3, the hooks 21*b*A, 21*b*B of the lock arms 21A, 21B are pressed inward towards the body 10, so that the lock arms 21A, 21B are deflected inward. With the lock arms 21A, 21B deflected, the connector 1 is drawn in a direction opposite to the insertion direction (direction of arrow y) and the connector 1 is detached from the panel 3.

Figure 4A:
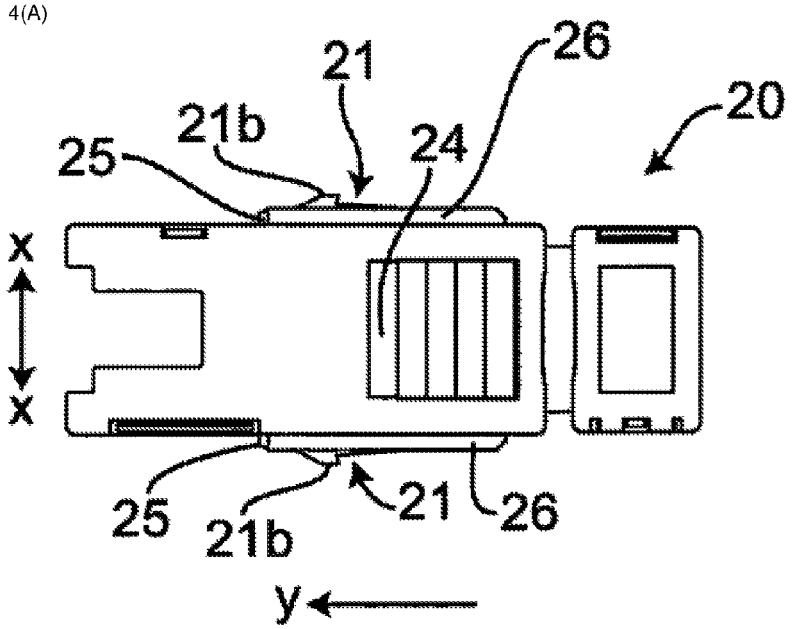
FIG. 4(A) is a plan view of a resin-molded component of two resin-molded components constituting an housing.
Figure 4B:
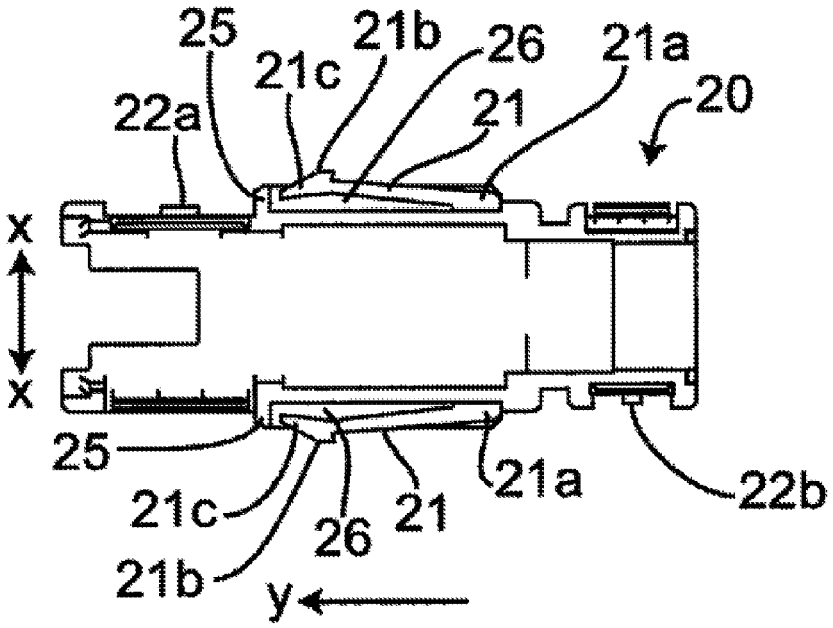
FIG. 4(B) is a bottom view of one resin-molded component of two resin-molded components constituting a housing.

In FIG. 4, since the two housing members 20A and 20B have identical structures, the elements of the housing members 20A,20B are shown without the distinguishing "A" and "B" sub-reference letters.

In the embodiment shown in FIG. 1, the housing 20 includes front walls 25A, 25B and sidewalls 26A, 26B. The front walls 25A, 25B extend from the upper face to the lower face of the housing 20, perpendicular to the insertion direction. The front walls 25A, 25B are positioned adjacent to the free ends 21*c* of the lock arms 21A, 21B. The front walls 25A, 25B extend outward from the housing 20 to have a height covering a portion of the free end 21*c* of the lock arm 21, as shown with a front wall 25 in FIG. 4, such that the height of the front walls 25A, 25B is greater than or equal to a distance between the front end 21*c* and the housing 20. The front walls 25 serve as a barrier to prevent a foreign object from being inserted under the lock arms 21A, 21B from the free end 21*c* of the lock arms 21A, 21B, by blocking such an intrusion. Therefore, even when the connector 1 is connected with the mating connector without the interposition of the panel 3, intrusion of the foreign object from the free end 21*c* is prevented.

Sidewalls 26A, 26B are positioned on the housing 20 such the sidewalls 26A, 26B sandwich the two lock arms 21A, 21B, extending parallel with the lock arms 21A,21B along the insertion direction. The sidewalls 26A,26B extend outward from the housing 20 to have a height covering the lock arm 21, excepting the hook 21*b*, as shown by the sidewall 26 in FIG. 4, such that the height of the sidewalls 26A,26B is greater than or equal to a distance between the front end 21*c* and the housing 20. The sidewalls 26 serve as a barrier to prevent a foreign object from being inserted under the lock arms 21A, 21B from the sides of the lock arms 21A, 21B, by blocking such an intrusion. Therefore, even when the connector 1 is connected with the mating connector without the interposition of the panel 3, the intrusion of the foreign object from the sides is also prevented.

The hooks 21*b*A, 21*b*B disposed on the outer surface of the free end 21*c* have a distance from the housing 20 that is greater than the height of the front wall 25A,25B, or the first and second side walls 26A, 26B. See FIG. 4(B).

In the embodiment shown in FIG. 1, the two lock arms 21A, 21B, the front walls 25A, 25B, and the sidewalls 26A, 26B are positioned on each of the two side faces of the housing 20. On each of the two side faces of the housing 20, the first lock arm 21A, the first front wall 25A, and first sidewall 26A are formed on the housing member 20A. The second lock arm 21B, the second front wall 25B, and the second sidewall 26B are formed on the other housing member 20B. Consequently, for each of the housing members 20A, 20B, one side of the lock arms 21A, 21B is open. Therefore, the housing members 20A, 20B can be manufactured by means of a mold structured so as to be drawn from the open side. When the two housing members 20A, 20B are mated with each other, the housing 20 is such that the lock arms 21A, 21B are positioned side by side and the pair of sidewalls 26A, 26B sandwich the two lock arms 21A, 21B, so that intrusion of a foreign object from the side of each of the lock arms 21A, 21B is also prevented.

Further, since the connector 1 has lock arms 21A, 21B, the front walls 25A, 25B, and the sidewalls 26A, 26B on both sides in the width direction (direction of arrow x-x), the connector 1 is stably attached to the panel 3. Further, since the housing 20 has the two housing members 20A, 20B, and the two lock arms 21A, 21B are formed on the two housing members 20A, 20B, the two housing members 20A, 20B are each attached to the panel 3. This configuration contributes to a stable attachment of the connector 1 to the panel 3.

While the above described embodiments show the two housing members 20A, 20B as having identical shapes, in other embodiments, the two housing members have different shapes. For example, the structure may be such that one housing member has a lock arm, a front wall, and a first sidewall, while the other housing member has a second sidewall.

In addition, in this embodiment, the lock arms, the front walls, and the sidewalls are provided on the housing that is a separate member from the housing, but, in a case where the connector does not have the metal body, the lock arms or the like may be provided directly in the housing accommodating a contact.

What is claimed is:

1. An electrical connector housing comprising:

a first housing member;

a second housing member being matable with the first housing member;

a front wall disposed on an outer surface of at least one of the housing members and extending perpendicular to an insertion direction;

a first sidewall disposed on the outer surface of the first housing member and extending along the insertion direction, perpendicular to the front wall;

a second sidewall disposed on the outer surface of the second housing member and extending along the insertion direction, parallel with the first sidewall and perpendicular to the front wall; and a cantilevered first lock arm extending along an insertion direction and positioned between the first sidewall and second sidewall, the lock arm having:

a fixed end connected to at least one of the housing members, a free end extending obliquely away from the fixed end towards the front wall, and spaced from the housing member at a distance less than or equal to a height of the front wall, and a hook positioned on an outer surface of the free end and projecting outward at a distance from the housing member that is greater than the height of the front wall.

2. The electrical connector housing of claim 1, wherein a first set including the first lock arm, the front wall, first sidewall, and second sidewall, is formed on a first side of the housing.

3. The electrical connector housing of claim 2, wherein a second set including the first lock arm, the front wall, first sidewall, and second sidewall is formed on a second side of the housing.

4. The electrical connector housing of claim 3, wherein the second side of the housing is opposite the first side and extends substantially parallel with the first side.

5. The electrical connector housing of claim 4, wherein the first set and the second set further comprise a second cantilevered lock arm having an identical structure as the first lock arm, and positioned adjacent to the first lock arm, extending along an insertion direction and positioned between the first sidewall and the second sidewall.

6. The electrical connector housing of claim 5, wherein the first housing member includes the first lock arm, a first portion of the front wall extending across the free end of the first lock arm, and the first sidewall of the first set.

7. The electrical connector housing of claim 6, wherein the second housing member includes the second lock arm, a second portion of the front wall extending across the free end of the second lock arm, and the second sidewall of the first set.

8. The electrical connector housing of claim 7, wherein the first set includes the first lock arm and the second lock arm positioned side by side.

9. The electrical connector housing of claim 8, wherein the first lock arm and the second lock arm of the first set are positioned between the first and second sidewalls of the first set when the first housing member and the second housing member are mated together.

10. The electrical connector housing of claim 9, wherein the second housing member includes the first lock arm, a first portion of the front wall extending across the free end of the first lock arm, and the first sidewall of the first set.

11. The electrical connector housing of claim 10, wherein the first housing member includes the second lock arm, a second portion of the front wall extending across the free end of the second lock arm, and the second sidewall of the second set.

12. The electrical connector housing of claim 11, wherein the first lock arm and the second lock arm of the second set are positioned between the first and second sidewalls of the second set when the first housing member and the second housing member are mated together.

13. The electrical connector housing of claim 1, wherein the first sidewall extends from a first end of the front wall and the second sidewall extends from a second end of the front wall to form an approximate U-shape.

14. The electrical connector housing according to claim 1, wherein the first and second housing members having substantially identical shapes.

* * * * *